United States Patent [19]

Kaartinen et al.

[11] Patent Number: 4,588,554

[45] Date of Patent: May 13, 1986

[54] REAGENT PACKAGE

[75] Inventors: Niilo Kaartinen, Kuusisto; Henrik Johansson, Espoo, both of Finland

[73] Assignee: Fluilogic Systems Oy, Finland

[21] Appl. No.: 697,700

[22] Filed: Feb. 4, 1985

Related U.S. Application Data

[63] Continuation of Ser. No. 468,948, Feb. 23, 1983, abandoned.

[30] Foreign Application Priority Data

Feb. 25, 1982 [FI] Finland ..... 820656

[51] Int. Cl.[4] ..... B01L 3/00; B65D 30/22; B65D 33/16; B65D 33/36

[52] U.S. Cl. ..... 422/61; 222/94; 383/37; 383/38; 383/40; 383/41; 383/93; 383/94; 383/116; 422/102; 436/166; 604/410

[58] Field of Search ..... 422/58, 61, 102, 103; 436/11, 68, 166; 604/408, 409, 410; 222/92, 107, 94; 141/10, 114, 237, 313, 315, 316, 317; 73/863.31, 863.32; 383/93, 94, 37, 38, 40, 41, 116; 53/467, 553, 555, 567

[56] References Cited

U.S. PATENT DOCUMENTS

| | | | |
|---|---|---|---|
| 2,589,743 | 3/1952 | Snaith | 222/94 |
| 3,177,871 | 4/1965 | Meyers | 604/262 X |
| 3,187,750 | 6/1965 | Tenczar | 604/410 |
| 3,545,671 | 12/1970 | Ross | 383/38 X |
| 3,566,930 | 3/1971 | Kirschner | 141/313 X |
| 3,572,552 | 3/1971 | Guinn | 73/863.32 X |
| 3,647,386 | 3/1972 | Gilford | 383/93 X |
| 3,729,553 | 4/1973 | Gold et al. | 222/94 X |
| 3,857,485 | 12/1974 | Frank | 356/246 X |
| 3,898,457 | 8/1975 | Packard et al. | 422/71 X |
| 3,905,477 | 9/1975 | Graham | 604/262 X |
| 3,961,899 | 6/1976 | Trivedi | 422/102 |
| 4,010,786 | 3/1977 | Aguettant et al. | 141/313 X |
| 4,116,336 | 9/1978 | Sorensen et al. | 422/61 X |
| 4,235,233 | 11/1980 | Mouwen | 383/38 X |
| 4,266,692 | 5/1981 | Clark | 222/107 X |
| 4,269,212 | 5/1981 | Kaartinen | 137/13 |
| 4,275,823 | 6/1981 | Credle, Jr. | 222/94 |
| 4,415,085 | 11/1983 | Clarke et al. | 222/107 X |
| 4,452,378 | 6/1984 | Christine | 222/107 |
| 4,479,989 | 10/1984 | Mahal | 604/408 X |
| 4,542,530 | 9/1985 | Thomas et al. | 383/93 X |

FOREIGN PATENT DOCUMENTS

| | | | |
|---|---|---|---|
| 0069247 | 1/1983 | European Pat. Off. | 422/58 |

OTHER PUBLICATIONS

Claren et al., European Patent Application, 1/12/83.

*Primary Examiner*—Barry S. Richman
*Assistant Examiner*—Robert J. Hill, Jr
*Attorney, Agent, or Firm*—Pahl, Lorusso & Loud

[57] ABSTRACT

The invention concerns a procedure for keeping and taking into use an analytic reagent or another substance used in analyses, and a reagent package to be used in the procedure. The package consists of a gas-tight sachet or of a combination consisting of several sachets, where the sachets comprises at least one flexible wall and a blank for forming a discharge aperture. The blank may consist of a hermetically sealed flexible tube extending into the interior of the sachet or a bar-like member with openings defined therein that extend into the sachets. The taking into use of the substance packed in the sachet is then accomplished by opening the flexible tube or the openings in the bar-like member and connecting the tube or the openings to the analyzer with an outward gas-tight connection. The substance is thereafter drawn from the sachet into said apparatus in one or several steps so that the sachet will collapse in connection with the discharge. Thanks to the gas-tight sealing of the sachet and of the connection between it and the analyzer, the substance packed in the sachet remains sterile and unchanged of its concentration not only before the substance is taken into use but also up to such time when the substance has been used up.

9 Claims, 14 Drawing Figures

REAGENT PACKAGE

This is a continuation of application Ser. No. 468,948, filed Feb. 23, 1983, now abandoned.

The present invention concerns a procedure for keeping and for taking into use an analytic reagent or another substance used in analyses.

Technically manufactured analytical reagents, and standard and control materials for use in analyses, are usually packed in glass bottles, ampoules or plastic bottles, either in liquid or solid form. In most instances, the person making the analysis must manually dilute and mix a plurality of reagents for each single analysis. As a consequence, making an analysis requires professional skill and good understanding of the chemistry involved. A drawback of known procedures is that the room temperature, evaporation during various handling phases and microbiological contamination may impair the keeping quality of the reagents and other materials that are used so that they are usable during a brief period only. Thus, of the total reagent consumption only a fraction is actually used in analysis.

The object of the invention is to provide a procedure which is free of the drawbacks mentioned. The invention is characterized in that the substance to be used in analysis is hermetically packed in a bag, or sachet, serving as a storage container and having at least one flexible wall. Use of the substance is accomplished by forming a discharging aperture in the sachet such that the sachet is connected through its discharging aperture to the apparatus using the substance, for instance an analyser, with an outward substantially gas-tight connection. Substance is drawn from the sachet into said apparatus in one or several steps so that the sachet collapses in connection with the discharging.

By using the invention, there is no evaporation of the substance to be used in analysis before nor after it is taken into use. Thereby the concentration of the substance is kept constant at all times until the sachet connected to the analyser has been totally emptied. Thus, the contents of the sachet may be utilized in their entirety, independent of the quantity of substance that has been packed in the sachet. A further consequence of the sachet's gas tightness is that the package is completely sterile and that no contamination whatsoever can occur.

Thanks to the flexibility and collapsibility of the sachet, one sachet size may be used to package even greatly varying substance quantities. In most instances the substance to be packed in the sachets is liquid, but the sachet is equally suitable as a package for gaseous or solid substances. Packaging of solid substance may be achieved when the substance is unstable as a solution but stable in solid form, and conversion of the solid substance to a solution is then effected in the sachet before the substance is used.

The invention is particularly applicable to automatic analysers, for instance in an analyser of the type disclosed in the Finnish Pat. No. 57850. When using such analysers, in conjunction with the applicants' invention, one is spared all the awkward and exacting manual work, since the sachet containing reagent can be so connected to the analyser that the analyser itself performs the extraction of the substance from the sachet, as well as all subsequent operations.

The invention also concerns a reagent package intended for application of the procedure presented. The package is characterized in that it consists of a gas-tight sachet or of a combination of several sachets, where the sachet comprises at least one flexible wall and a blank for the forming of a discharging aperture, so that the sachet can be connected by an outward substantially gas-tight connection to an analyser or equivalent apparatus and can be emptied by suction so that the sachet will collapse in connection with such emptying.

The sachet constituting the reagent package of the invention is preferably substantially flat and comprises two opposed, flexible walls, which are urged against each other as the sachet is emptied. The said walls may consist of a lamination formed of a metal foil and a plastic film on its inside, and the plastic may have seams around the edges of the sachet closing the sachet, these seams being established by a heat seaming process.

Establishing the discharging aperture may be accomplished by a flexible tube extending into the sachet and which tube is hermetically closed at the packaging step. On being opened, the flexible tube will then serve as discharge aperture. Furthermore, the flexible tube may at the packaging step serve as a passage by which the sachet, previously formed to be gas-tight, is filled. The flexible tube is preferably made of the same plastic material as that with which the sachet is seamed, and hermetical closing of the sachet may in that case be accomplished by heat seaming.

The sachet may, instead of said flexible tube, comprise a bar-like body attached to an edge of the sachet by heating seaming and containing a passage extending to the opening of the bag and hermetically sealed at the packaging step and which can be opened for forming a discharge aperture. The bar-like body likewise preferably consists of plastic and has been sealed to the plastic material that is used in seaming the edges of the sachet.

The reagent package of the invention may consist not only of a single sachet but also of a sachet combination with a plurality of sachets attached to each other by their edges and with the different sachets preferably containing different reagents. Such a combination of sachets, connectable as such to an analyser, may contain all the reagents and other substances needed in a given analysis. The substance quantities contained in different sachets may then be quite radically different, but it is possible in spite of this to make the sachets in the combination of equal perimeters. On the other hand, of course, the sachets may be different in size, provided that the blanks provided to form the discharge apertures are so disposed that the combination is connectable as it is to the connecting conduits of the analyser.

BRIEF DESCRIPTION OF THE DRAWING

The invention is described in the following in greater detail with the aid of examples with reference to the attached drawing, wherein:

In FIGS. 1–3 is depicted a gas-tight sachet 1, constituting the reagent package of the invention. The sachet 1 is substantially flat and comprises two opposed, flexible walls 2, which have been seamed on the edges of the sachet to adhere to each other and form seams 3. The walls 2 consist of three-ply lamination having as its innermost ply 4 a film of polyethylene, the next ply 5 being an aluminium foil and the outermost ply 6, a polyamide film. The polyethylene has the task to form the seams 3 on the edes of the sachet, which have been formed by heat-seaming the opposed polyethylene films 4 to each other, and furthermore the polyethylene film is a suitable inert material to be used for the inside surface of the sachet 1 which comes into immediate contact with the material packed in the sachet. The purpose of the aluminum foil 5 over the polyethylene film is to endow the sachet 1 with requisite gas-tightness, and with the aid of the outermost polyamide film 6, a tough and mechanically durable surface of the sachet has been produced. A flexible tube 7 leading into the interior of the sachet has been affixed to the sachet 1 by seaming, and this flexible tube is hermetically closed until the substance packed in the sachet is used.

At the packaging step, an analytic reagent or another substance for use in analysis is enclosed in the sachet 1. The reagent or substance may be a standard or control material, which in most instances is liquid but may also be in solid or gaseous form. A liquid reagent is preferably, when being packaged, free of foreign gases such as oxygen which might impair the keeping quality of the reagent or interfere with the analysis. The packaging may be accomplished by filling previously seamed sachet 1 through the flexible tube 7, whereafter the flexible tube 7 is sealed. A possible alternative is to place the substance in the sachet while the sachet is still partly unseamed, and then to close the sachet by finally seaming the edges closed.

To use the substance packed in the sachet 1 the flexible tube 7 is opened and the sachet is connected to the apparatus using the substance, such as an analyser, by this tube with a connection which is outward substantially gas-tight. The substance may then be drawn by suction from the sachet 1 into the apparatus in one or several steps so that the sachet will collapse in connection with emptying. Thanks to the gas-tightness of the sachet and of the connection between it and the analyser, even prolonged intervals may be allowed between discharging steps without incurring any change of the substance in the sachet.

Figure 1:
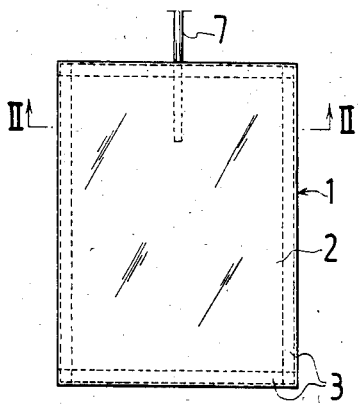
FIG. 1 presents the sachet, fitted with a flexible tube, constituting a reagent package according to the invention.
Figure 4:
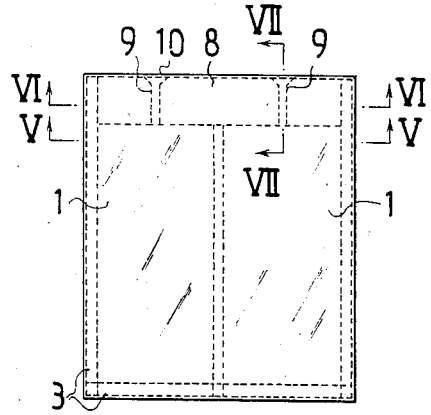
FIG. 4 presents a reagent package according to the invention consisting of two sachets, attached to each other, and each provided with a passage through which the sachet may be filled or emptied.
Figure 2:
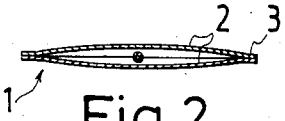
FIG. 2 shows the section II—II from FIG. 1.
Figure 5:
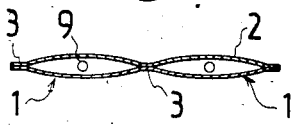
FIG. 5 shows the section V—V from FIG. 4.
Figure 3:
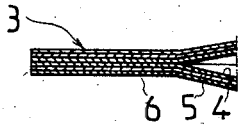
FIG. 3 presents, sectioned, the seam area on the edge of the sachet of FIG. 1.
Figure 6:
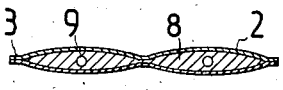
FIG. 6 shows the section VI—VI from FIG. 4.
Figure 7:
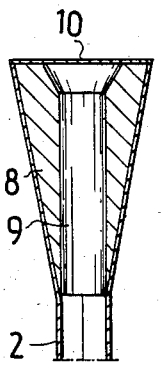
FIG. 7 shows the passage belonging to a single sachet, presented as section VII—VII from FIG. 4.

In FIGS. 4–7 is depicted a reagent package consisting of two sachets 1 placed side by side and attached to each other. The sachets are equivalent to the embodiment of FIGS. 1–3 described above, as regards the material of their walls 2 and their edge seams 3. However, an essential difference is that the sachets comprise no flexible tubes extending into their interior. Instead, the sachets 1 are provided with a common, bar-like polyethylene body 8 affixed to the end of the sachets by seaming. In the body 8, passages 9 have been formed which are hermetically closed with a polyethylene film 10 seamed fast to the edge of the body at the packaging step.

Figure 8:
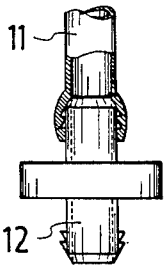
FIG. 8 presents the end of a connecting conduit belonging to the analyser and connectable to the passage of FIG. 7, FIG. 9 displays schematically a reagent package according to the invention, consisting of a sachet combination comprising ten sachets, connected with an analyser through two connector banks and conduits departing therefrom.

Use of the package shown in FIGS. 4–7 takes place by hermetically connecting the sachets 1 to the analyzer by the passages 9 and by connecting conduits 11,. In FIG. 8 is shown the end of a connecting conduit 11 and a tubular mandrel 12 attached thereto, which pierces the film 10 on the mouth of the passage 9 and thereafter connects the passage 9 and the connecting conduit 11.

The package according to FIGS. 4–7, comprising two sachets, is the simplest possible combination package, in which the sachets may contain different reagents used in the same context. It is thus not intended to separate the sachets at any stage: the package is in contrast connected to the analyser as one single entity.

Figure 9:
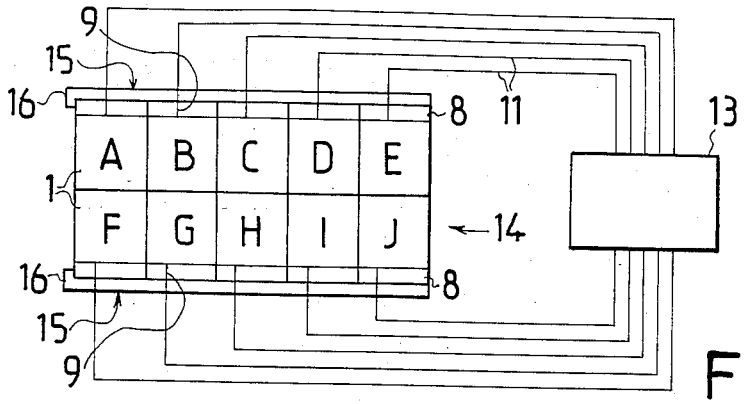
Figure 10:
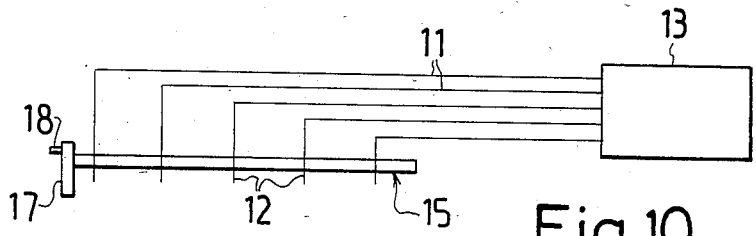
FIG. 10 displays, in elevational view, the connector bank connected by conduits to the analyser and which is attachable to a reagent package according to the invention comprising a plurality of sachets side by side.
Figure 12:
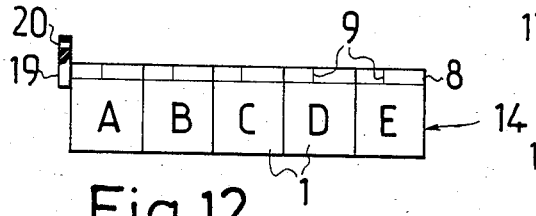
FIG. 12 presents in elevational view a reagent package according to the invention, comprising five sachets side by side, to which the connector bank of FIG. 10 is connectable, FIG. 13 displays part of the reagent package of FIG. 12, viewed from the front.
Figure 11:
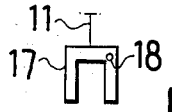
FIG. 11 shows the connector bank of FIG. 10, viewed from the front.
Figure 13:
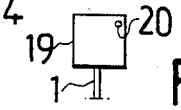

In FIG. 9 is depicted a combination package 14 connected by conduits 11 to an analyser 13, this combination package consisting of ten sachets 1, denoted with A to J in the figure. The sachets may be constructed as in FIGS. 4–7 and they may contain all the reagents and other substances needed to carry out a given analysis. Two bar-like connector banks 15 having on their ends projections 16, have been used to connect the package 14 to the analyzer 13. The passages 9 in the bar-like bodies 8 of the package 14, which lead into the sachets 1, are slightly offset from the centre-lines of the sachets, this offset being larger on one side of the package than on the other. The connector banks 15 have been provided with mandrels pushing into the passages 9, which mandrels may have the shape shown in FIG. 8 (reference numeral 12) and are located on the connector banks in register with the passages. Due to the location of the projections 16 and the passages 9 and mandrels on the connector banks 15, each connector is only connectable in one given position on one given side of the package 14. Thus, each conduit 11 going to the analyser 13 can only become connected with one predetermined sachet 1 in the package 14 and thus no possibility of misconnection exists.

Figure 14:
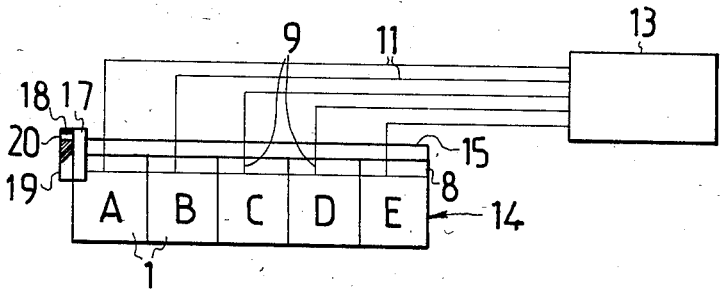
FIG. 14 shows the connector bank of FIG. 10 and the reagent package of FIG. 12 connected to each other.

In FIGS. 10–14 has been presented a further embodiment of the combination package 14 of the invention, connectable to the analyser 13 through a connector bank 15. The connector bank 15, depicted in FIGS. 10 and 11, consists of an elongated rod with which the conduits 11 going to the analyser 13 connect and which carries mandrels 12, which enter the package 14, on the end of each conduit. The end of the connector 15 has been connected with a member 17 shaped like an inverted letter U and provided with a projecting pin 18. The combination package 14, presented in FIGS. 12 and 14, consists of five sachets 1 side by side, these sachets being indicated with A to E, and of a bar-like member 8, as described above, provided with passages 9 leading into the sachets. On the end of the package 14 has been affixed a plate-like member 19 with a hole 20 corresponding to the pin 18 belonging to the connector 15. When attaching the connector 15 and package 14 to each other as shown in FIG. 14, the members 17 and 19 are first placed against each other so that the pin 18 enters the hole 20. Next, the bar-shaped part of the connector 15, which is movable with reference to the member 17, is pressed against the bar-like body 8 of the package 14 so that the mandrels 12 enter the passages 9 leading into the sachets 1. It is essential in the design solution of FIGS. 10–14 that the attachment of the package 14 and the connector bank 15 is conditional on compatibility between the pin 18 and hole 20. In a case in which a great variety of different combination packages are to be connected over connector banks to the same analyzer, it is possible to make sure that each type of package can only be connected to a given connector bank by varying the location of the pin 18 and hole 20 on the members 17 and 19, thereby eliminating the possibility of missconnection.

Preliminary tests carried out with packages according to the invention have demonstrated that the losses by evaporation from the package, per unit area, are only about 0.2 to 0.3% of the losses taking place from conventional reagent packages of prior art.

It is obvious to a person skilled in the art that various embodiments of the invention are not confined to the examples presented and may instead vary within the scope of the claims following below.

We claim:

1. A reagent package comprising:

means defining at least one set of plural adjacent gas-tight chambers wherein each chamber has an interior and contains a reagent for an analysis, said means defining at least one set of chambers comprising two opposed walls and at least one bar-like member having a plurality of transversal passages defined therein, the number of said bar-like members being equal to the number of chamber sets and each set of chambers having only one bar-like member corresponding thereto, wherein each wall comprises a metallic, gas impermeable foil and wherein at least one wall is flexible so that each chamber is capable of being flattened when emptied, each chamber having a perimeter with a portion of its perimeter being defined by a seam formed by seaming said two opposed walls together and the remaining portion of its perimeter being defined by a said bar-like member that has been seamed between said two opposed walls along an edge of the package in such a manner that each of its transversal passages corresponds to and extends into the interior of only one chamber in its corresponding set of chambers and each member of its corresponding set of chambers has a transversal passage extending therein, and wherein said passages are hermetically sealed and are capable of being opened for discharging the reagents from the chambers through at least one discharging means that has been connected to the package by a gas-tight connection.

2. The reagent package according to claim 1 wherein said at least one bar-like member comprises polyethylene.

3. The reagent package according to claim 1 wherein different chambers of the package contain different reagents.

4. The reagent package according to claim 1 wherein both of the two opposed walls are flexible.

5. The reagent package according to claim 4 wherein each of the two opposed walls comprises a laminant comprising a plastic film adjacent to the interior of each of the chambers and a metallic foil, and the seams formed by seaming the two opposed walls together are formed by heat seaming of the plastic film.

6. The reagent package according to claim 5 wherein the metallic foil consists of aluminum and the plastic film consists of polyethylene.

7. A combination of the reagent package of claim 1 and at least one member for discharging reagents contained in the reagent package, wherein said at least one discharging member is in the shape of a bar and comprises a plurality of discharge conduits and a plurality of laterally protruding tubular mandrels, wherein said tubular mandrels form ends of said discharge conduits, are separated by distances corresponding to distances between passages in a corresponding bar-like member of the reagent package, and are adapted to enter into the passages of the corresponding bar-like member to open its passages and form a gas-tight connection therebetween.

8. The combination according to claim 7 wherein said reagent package is provided with at least one specific locking member spaced apart from the passages of the reagent package and said at least one discharging member is provided with a specific mating member spaced apart from its mandrels, said mating member of said at least one discharging member being compatible with a said specific locking member so as to lock with each other when said at least one discharging member is connected to a corresponding bar-like member of the reagent package.

9. The combination according to claim 7 wherein the discharge conduits of said at least one discharging member terminate at an analyzer which consumes the reagents in the reagent package.

* * * * *